US008833438B2

(12) United States Patent
Wyatt et al.

(10) Patent No.: US 8,833,438 B2
(45) Date of Patent: Sep. 16, 2014

(54) MULTI-ORIENTATION SINGLE OR TWO PHASE COLDPLATE WITH POSITIVE FLOW CHARACTERISTICS

(75) Inventors: William G. Wyatt, Plano, TX (US); James A. Pruett, Lucas, TX (US); Gary Schwartz, Dallas, TX (US)

(73) Assignee: Raytheon Company, Waltham, MA (US)

( * ) Notice: Subject to any disclaimer, the term of this patent is extended or adjusted under 35 U.S.C. 154(b) by 1144 days.

(21) Appl. No.: 11/947,033

(22) Filed: Nov. 29, 2007

(65) Prior Publication Data

US 2008/0128117 A1 Jun. 5, 2008

Related U.S. Application Data

(60) Provisional application No. 60/867,717, filed on Nov. 29, 2006.

(51) Int. Cl.
*F28F 3/12* (2006.01)
*F28D 15/02* (2006.01)

(52) U.S. Cl.
CPC ..... *F28D 15/0233* (2013.01); *F28D 15/0275* (2013.01)
USPC ..... 165/168; 165/80.4; 165/153

(58) Field of Classification Search
USPC ..... 165/168, 153
See application file for complete search history.

(56) References Cited

U.S. PATENT DOCUMENTS

| | | | | |
|---|---|---|---|---|
| 3,327,776 | A | 6/1967 | Butt | |
| 3,817,321 | A * | 6/1974 | Von Cube et al. | 165/104.22 |
| 4,081,026 | A * | 3/1978 | Kleine et al. | 165/170 |
| 4,122,828 | A * | 10/1978 | DiPeri | 126/671 |
| 4,186,720 | A * | 2/1980 | Schmauder et al. | 126/667 |
| 4,898,153 | A | 2/1990 | Sherwood | |
| 5,737,186 | A * | 4/1998 | Fuesser et al. | 361/699 |
| 5,983,997 | A * | 11/1999 | Hou | 165/144 |
| 2004/0221603 | A1 * | 11/2004 | Arik et al. | 62/259.2 |
| 2006/0032611 | A1 * | 2/2006 | Fujisaki | 165/80.4 |

OTHER PUBLICATIONS

PDF of Fraas Book.*

* cited by examiner

*Primary Examiner* — Brandon M Rosati

(57) ABSTRACT

An apparatus, system and method for multi-orientation single or two phase coldplate with positive flow characteristics is disclosed. In representative embodiments and applications, the present invention generally provides improved methods and systems for cooling through fluid cooled coldplates.

20 Claims, 5 Drawing Sheets

MULTI-ORIENTATION SINGLE OR TWO PHASE COLDPLATE WITH POSITIVE FLOW CHARACTERISTICS

RELATED APPLICATIONS

This application claims the benefit of U.S. Provisional Patent Application Ser. No. 60/867,717 filed in the United States Patent and Trademark Office on Nov. 29, 2006.

BACKGROUND OF INVENTION

Various techniques are used to facilitate cooling of mechanical and electronic equipment. The ability to provide sufficient cooling to components that experience heat gain is essential to proper function and product reliability. Common methods of cooling typically include forced movement of ambient air, radiators, heatsinks, and use of cooling liquids. Cooling may be as simple as using a fan to move relatively cooler air over a component that has experienced.

Prior attempts to address this problem have resulted in coldplates that have difficulty maintaining uniform fluid velocity in the flow region due to gravitational effects when the coldplate is positioned in multiple orientations. Regions also develop where fluid velocity in the flow region is greatly reduced, affecting the ability of the coldplate to transfer heat. Additionally, coldplates with unidirectional fluid flow have large local temperature deltas. Accordingly, there exists a need to address these and other deficiencies associated with conventional techniques.

SUMMARY OF THE INVENTION

In a representative aspect, the present invention includes a system and method for improved equipment cooling. The system comprises a fluid cooled coldplate and/or the like. In accordance with various aspects of the present invention, the system may provide cooling regardless of the orientation of the coldplate during operation. The coldplate may be designed to provide substantially uniform fluid velocity throughout the coldplate thereby reducing localized regions of trapped fluid and increasing the cooling efficiency of the system.

BRIEF DESCRIPTION OF THE DRAWINGS

Representative elements, operational features, applications and/or advantages of the present invention reside inter alia in the details of construction and operation as more fully hereafter depicted, described or otherwise identified—reference being made to the accompanying drawings, images, figures, etc. forming a part hereof—wherein like numerals refer to like parts throughout. Other elements, operational features, applications and/or advantages will become apparent in view of certain exemplary embodiments recited in the claims.

Elements in the figures, drawings, images, etc. are illustrated for simplicity and clarity and have not necessarily been drawn to scale. For example, the dimensions of some of the elements in the figures may be exaggerated relative to other elements to help improve understanding of various embodiments of the present invention. Furthermore, the terms 'first', 'second', and the like herein, if any, are used inter alia for distinguishing between similar elements and not necessarily for describing a sequential or chronological order. Moreover, the terms 'front', 'back', 'top', 'bottom', 'over', 'under', and the like in the disclosure and/or in the claims, are generally employed for descriptive purposes and not necessarily for comprehensively describing exclusive relative position. It will be understood that any of the preceding terms so used may be interchanged under appropriate circumstances such that various embodiments of the invention described herein, for example, are capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventors' conception of the best mode, and are not intended to limit the applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

The present invention may be described herein in terms of conventional coldplates, flow passages, and fluids. Further, the present invention may employ any number of conventional techniques for fluid cooling and/or the like.

It should be appreciated that coldplates in accordance with various aspects of the present invention may comprise any number of conventional materials including but not limited to ceramics, metals, plastics, fiberglass, glass, various other inorganic and organic materials and/or the like. Further, coldplates in accordance with the present invention may comprise various forms, layers, sizes, thicknesses, textures and dimensions and/or the like.

Figure 1:
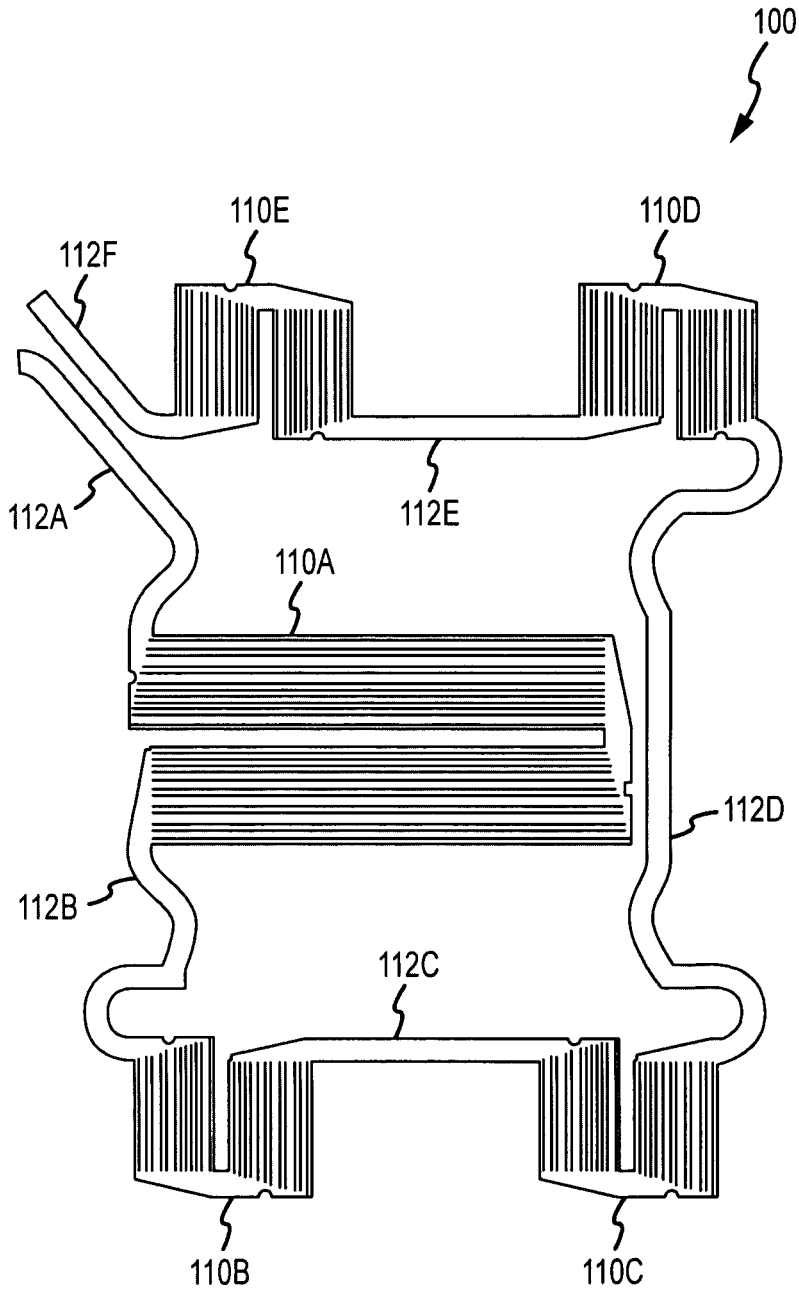
FIG. 1 representatively illustrates a coldplate system in accordance with a representative embodiment of the present invention.

Referring now to FIG. 1, a system for providing a multi-orientation coldplate 100 in accordance with various aspects of the present invention may be implemented in conjunction with a series of coldplate sections 110A-E and series of fluid flow sections 112A-F. The multi-orientation coldplate 100 may be configured such that the gravitational effects on the fluid are minimized regardless of the position of the multi-orientation coldplate 100 during use or installation. The multi-orientation coldplate 100 may comprise any suitable material such as ceramics, metals, plastics, fiberglass, glass, various other inorganic and organic materials and/or the like.

It should be appreciated that in accordance with various aspects of the present invention the flow sections 112 may be configured in any appropriate pattern and/or shape depending upon the specific application. For example, in a representative embodiment of the present invention, the flow sections 112 may comprise circular tubes and/or channels with one or more flattened sides.

In another representative embodiment of the present invention, a single bi-directional coldplate section, such as 112A, may comprise any suitable flow shape and further comprise partitions, channels, and/or fins for directing the fluid and to increase the surface area the fluid comes into contact with.

A coldplate section 110 in accordance with various aspects of the present invention may comprise multiple flow paths to modify local temperature deltas by forcing the fluid to sweep all regions of the coldplate despite the gravitational effects of installation or position during operation. In a representative embodiment of the present invention, each flow path may comprise an inlet, an outlet, and a set of partitions, channels, and/or fins that direct the flow direction of the fluid.

The cooling fluid in accordance with various aspects of the present invention may comprise any fluid, liquid/vapor and/or liquid/gas mixture suitable for cooling, stabilizing temperature and/or the like. In a representative embodiment of the present invention, the fluid may comprise any liquid that substantially maintains its physical state throughout the cooling cycle. The fluid may also be suitably configured to resist boiling. In another representative embodiment of the present invention, the fluid is suitably configured to absorb and/or dissipate heat.

It should be appreciated that in accordance with various aspects of the present invention the cooling fluid may be configured to function at various temperatures. For example, in a representative embodiment of the present invention, the cooling fluid may comprise any combination of water and propylene glycol, such as in a 50:50 ratio, and the fluid may be implemented in conjunction with the coldplate system to function at temperatures above and/or to about −30° C. In another representative embodiment of the present invention, the coldplate system may comprise a mixture of water and methanol, such as in a 50:50 ratio, and may be implemented in conjunction with a cooling system to function at temperatures below about −30° C.

Figure 2:
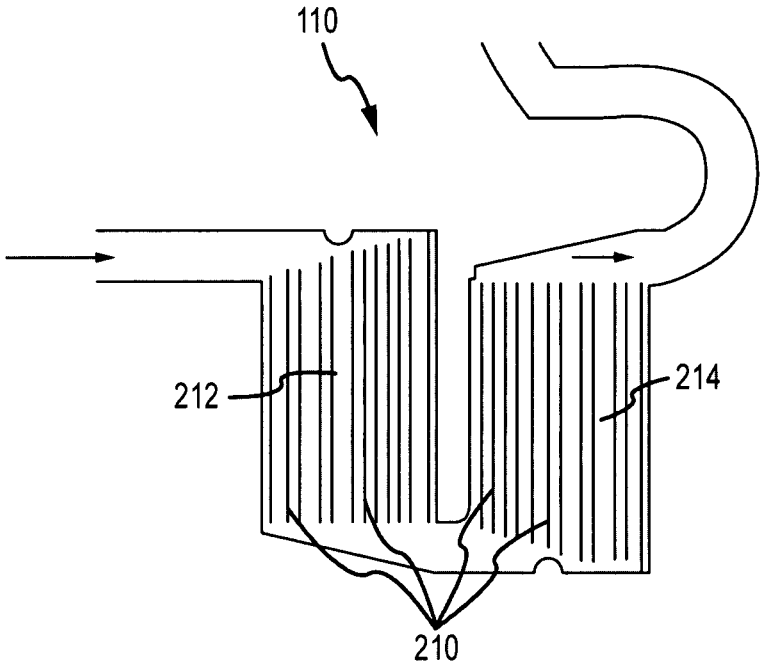
FIG. 2 representatively illustrates a single coldplate in accordance with a representative embodiment of the present invention.

Referring now to FIG. 2, in a representative embodiment of the present invention, a series of fins 210 of varying lengths may be employed in two separate flow regions 212 and 214. The fins 210 may comprise any suitable material such as ceramics, metals, plastics, fiberglass, glass, various other inorganic and organic materials and/or the like. The fins 210 generally direct the flow of the fluid and increase the surface area in contact with the fluid to facilitate the heat transfer between the fluid and the coldplate section 110.

Figure 3:
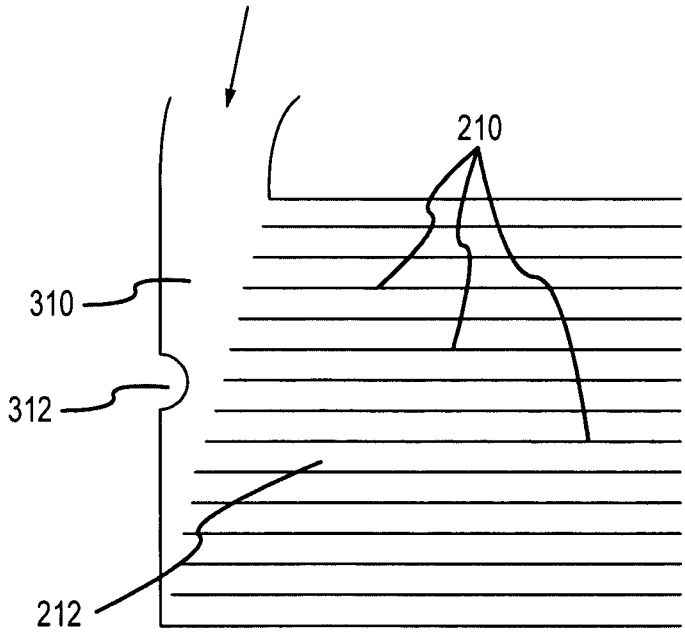
FIG. 3 representatively illustrates an inlet section of a cooling plate in accordance with a representative embodiment of the present invention.

In another representative embodiment of the present invention, the fins 210 may be oriented in a graduated manner at the inlet to flow region 212 that is substantially perpendicular to the flow of the incoming fluid. For example, referring now to FIG. 3, the graduated fins 210 may have the effect of reducing the volume in the inlet 310 as the fluid flows into the flow region 212 resulting in a more uniform fluid velocity throughout substantially the entire flow region 212.

The inlet 310 in accordance with various aspects of the present invention may further be configured with a surface that directs the fluid towards the fins 210 in order to obtain a more uniform fluid velocity through the fins 210. The surface may comprise any system for directing the flow of the fluid, such as an insert, a protrusion, a dome, a flange and/or the like. In a representative embodiment of the present invention, a protrusion 312 may be implemented to form a guiding wall that more efficiently direct the cooling fluid onto the graduated fins 210 and account for the momentum affects of the incoming fluid.

It should be appreciated that in accordance with various aspects of the present invention the coldplate section 110 may also comprise a transition section between the flow regions 212 and 214. In a representative embodiment of the present invention, fluid initially flows into the bi-directional coldplate section in one direction, through a set of fins 210, and is then redirected through a transition section to a second set of fins 210 where it flows in a different direction. In another representative embodiment of the present invention, the flow regions 212 and 214 are configured in substantially the opposite in direction.

It should be appreciated that, in accordance with various aspects of the present invention, the transition section may be configured in any way that results in the redirection of the flow of the fluid such as a bend in a pipe, an angled channel, and/or a series of ducts.

Figure 4:
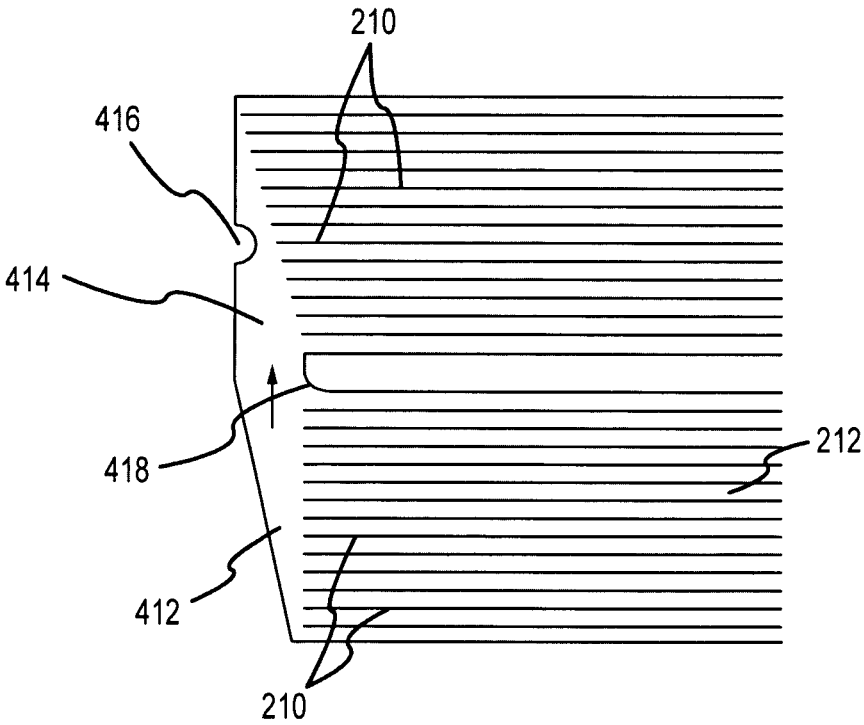
FIG. 4 representatively illustrates a transition between flow directions in a cooling plate in accordance with a representative embodiment of the present invention.

Referring now to FIG. 4, in a representative embodiment of the present invention, the transition section 410 may comprise a combination of a diverging region 412 and a converging region 414. The outlet section 412 may comprise the region where the first flow region 212 empties. The diverging region 412 may be configured to provide an increase in the volumetric area as the number of fins 210 increase in order to maintain a substantially uniform flow velocity of the cooling fluid. The converging region 414 may be positioned immediately downstream from the diverging region 412. The converging region 414 may be configured similar to the inlet of the coldplate section 110 with a protrusion 416 and a series of graduated fins 210 positioned substantially perpendicular to the flow of the fluid.

In another representative embodiment of the present invention, the transition section 410 may further comprise an element directed to reducing flow separation of the fluid in the transition area. The element may comprise any suitable method for achieving reduced flow separation such as a round off, an angled edge and/or corner, and/or a smooth edge in the direction of the desired flow path. For example, a rounded corner 418 is located in the flow channel nearest the transition point between the diverging region 412 and the converging region 414.

Figure 5:
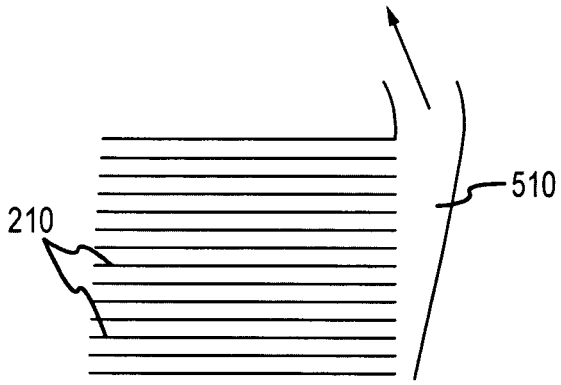
FIG. 5 representatively illustrates an exit area of a cooling plate in accordance with a representative embodiment of the present invention.

Referring now to FIG. 5, a coldplate section 110 may further comprise an outlet 510 of varying geometry. The outlet may be configured in any suitable way to provide an increase in volume in the outlet 510 as the number flow channels emptying into the outlet 510 increases. For example, in a representative embodiment of the present invention, the wall of the coldplate section 110 at the outlet 510 is configured to provide an increase in the volumetric area as the number of fins 210 empty fluid into the outlet 510 increases. Alternatively and/or conjunctively, in another representative embodiment of the present invention, the outlet 510 may comprise a constant volumetric area and the length of the fins 210 could be graduated in a manner similar to the inlet 310 such that the volume of the outlet 510 increases in the direction of the cooling fluid flow.

Multi-orientation coldplate system 100, in accordance with various aspects of the present invention, may be implemented such that a fluid is passed through the multi-orientation coldplate 100 in order to transfer heat from the surrounding area through the multi-orientation coldplate 100 and into the fluid and/or from the fluid through the multi-orientation coldplate 100 and to the surrounding area. In a representative embodiment of the present invention, the multi-orientation coldplate 100 comprises series of coldplate sections 110A-F.

The coldplate sections 110A-F may be configured to comprise one or more flow regions such that the velocity of the fluid may be substantially uniform throughout the coldplate section 110 thereby reducing localized temperature deltas at each coldplate 110. In a representative embodiment of the present invention, the multi-orientation coldplate 100 may be configured such that as the fluid enters the multi-orientation coldplate 100 it is directed into a first coldplate section 110A. The fluid may move into a first flow region 212 towards one or more fins 210 that redirect the fluid approximately ninety degrees along a series of flow channels where heat is then transferred into the fluid.

In another representative embodiment of the present invention, after redirection by one or more fins 210, the fluid flows into a region where the volumetric area increases in the direction of the fluid flow and the flow direction is again redirected approximately ninety degrees. The fluid may then move into a second flow region 214 where a second set of fins 210 are positioned to again redirect the flow approximately ninety degrees along a series of flow channels where heat is transferred into the fluid. Thereafter, the fluid may flow into a second expanding volumetric region before being directed out of the coldplate section 110. The fluid may then follow a flow section 112 before entering another coldplate section 110 to repeat the process.

The multiplate orientation coldplate system, in accordance with various aspects of the present invention, may be implemented to at least partially increase the effectiveness of uniform fluid velocity maintenance in a flow region due to gravitational effects. In a representative embodiment of the present invention, use of a multiplate orientation coldplate system may allow the coldplate's ability to transfer heat to be at least substantially maintained. In another representative embodiment of the present invention, fluid velocity in a flow region may be substantially maintained when a coldplate in accordance with the present invention is oriented in multiple directions. In yet a further embodiment of the present invention, multi-orientation coldplate systems in accordance with the present invention may comprise and/or maintain larger temperature deltas than conventional coldplates.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

We claim:

1. A cooling apparatus comprising a fluid cooled coldplate, the coldplate comprising:

an inlet;

a first heat transfer section comprising a plurality of first cooling fins of varying lengths positioned downstream from and engaging the inlet in a substantially perpendicular orientation relative to a direction of a flow of cooling fluid in the inlet, a first end of each first cooling fin and an inner surface of the inlet defining a cross-sectional area of the inlet at its respective first cooling fin, the first end of each first cooling fin extending into the inlet such that the cross-sectional area of the inlet decreases creating a converging section along the direction of the flow of the cooling fluid in the inlet, wherein the first heat transfer section is configured to transfer thermal energy to the cooling fluid passing through the first heat transfer section;

an outlet positioned downstream from the first heat transfer section in a substantially perpendicular orientation relative to a direction of the flow of the cooling fluid through the first cooling fins, wherein a second end of each first cooling fin and an inner surface of the outlet define a cross-sectional area of the outlet at its respective first cooling fin, the outlet comprising a diverging section in which the cross-sectional area of the outlet increases along a direction of the flow of the cooling fluid in the outlet, the second ends of the first cooling fins forming a plane that is substantially perpendicular to the direction of the flow of the cooling fluid through the first cooling fins; and a second heat transfer section comprising a plurality of second cooling fins, the second heat transfer section configured to provide a direction of the flow of the cooling fluid through the second cooling fins substantially opposite the direction of the flow of the cooling fluid through the first cooling fins so as to substantially minimize an effect of gravity on fluid velocity irrespective of an orientation of the coldplate, wherein the diverging section of the outlet is collinear with a converging section of a second inlet to the second heat transfer section;

wherein the first heat transfer section and the second heat transfer section are spaced apart and separated from each other but coupled by the outlet.

2. The apparatus of claim 1, wherein the first and second heat transfer sections are substantially inverse mirrors of one another.

3. The apparatus of claim 1, wherein the plurality of first cooling fins are configured to intercept and distribute the cooling fluid into a plurality of flow fields.

4. The apparatus of claim 3, wherein the first cooling fins extend further into the inlet as the cross-sectional area of the inlet decreases.

5. The apparatus of claim 3, further comprising a protruding surface on the inlet, the protruding surface configured to direct the cooling fluid to the first cooling fins.

6. A fluid cooled system, comprising:

a plurality of thermal exchanging sections, each thermal exchanging section comprising:

an inlet;

a portion positioned downstream from the inlet, the portion comprising a plurality of cooling fins of varying lengths, wherein the portion is configured to transfer thermal energy to a cooling fluid by passing the cooling fluid across the plurality of cooling fins, wherein the plurality of cooling fins are positioned substantially perpendicular in the inlet relative to a direction of a flow of the cooling fluid in the inlet, a first end of each cooling fin and an inner surface of the inlet defining a cross-sectional area of the inlet at its respective cooling fin, the first end of each cooling fin extending into the inlet such that the cross-sectional area of the inlet decreases along the direction of the flow of the cooling fluid in the inlet; and an outlet positioned downstream from the portion, a second end of each cooling fin and an inner surface of the outlet defining a cross-sectional area of the outlet at its respective cooling fin, the outlet comprising a diverging section in which the cross-sectional area of the outlet increases along a direction of the flow of the cooling fluid in the outlet, the second ends of the cooling fins forming a plane that is substantially perpendicular to the direction of the flow of the cooling fluid through the cooling fins;

wherein the plurality of thermal exchanging sections are spaced apart and separated from each other but coupled together via a plurality of fluid flow sections, directions of the flows of the cooling fluid through the plurality of cooling fins of the thermal exchanging sections having orientations different from one another such that a substantially uniform fluid velocity is maintained irrespective of orientations of the thermal exchanging sections with respect to gravity.

7. The system of claim 6, wherein:

the thermal exchanging system are grouped together in pairs, at least one first set of pairs has flows of the cooling fluid through the respective cooling fins that are substantially parallel in opposite directions;

at least one second set of pairs has flows of the cooling fluid through the respective cooling fins that are substantially perpendicular to the at least one first set of pairs.

8. The system of claim 6, wherein:

the outlet of at least a first of the thermal exchanging sections comprises a diverging section of increasing cross-sectional area in the direction of the flow of the cooling fluid in the outlet;

the inlet of at least a second of the thermal exchanging sections comprises a converging section of decreasing cross-sectional area in the direction of the flow of the cooling fluid in the inlet; and the inlet of the second thermal exchanging section is positioned immediately downstream from the outlet of the first thermal exchanging section.

9. The system of claim 8, wherein the cooling fins of the second thermal exchanging section extend further into the converging section as the cross-sectional area of the converging section decreases.

10. The system of claim 6, further comprising a protruding surface on the inlet of each thermal exchanging section, the protruding surface configured to direct the cooling fluid to the plurality of cooling fins.

11. A cooling method, comprising:

passing a cooling fluid to a plurality of thermal exchanging sections, each of the thermal exchanging sections having an inlet that includes a section of decreasing cross-sectional area in a direction of a flow of the cooling fluid through that inlet;

distributing the cooling fluid among a plurality of cooling fins in a portion of each thermal exchanging section, wherein each of the plurality of cooling fins of each thermal exchanging section has a first end that extends into the inlet of that thermal exchanging section such that the cross-sectional area of each inlet decreases along the direction of the flow of the cooling fluid through that inlet, wherein for each thermal exchanging section the first end of each cooling fin and an inner surface of the inlet define the cross-sectional area of the inlet at its respective cooling fin;

transferring heat to the cooling fluid in each of the thermal exchanging sections, wherein the thermal exchanging sections are spaced apart and separated from each other; and expelling the cooling fluid from an outlet of each thermal exchanging section, wherein for each thermal exchanging section a second end of each cooling fin and an inner surface of the outlet define a cross-sectional area of the outlet at its respective cooling fin, the outlet of each thermal exchanging section comprising a diverging section in which the cross-sectional area of the outlet increases along the direction of the flow of the cooling fluid through that outlet, the second ends of the cooling fins of each thermal exchanging section forming a plane that is substantially perpendicular to the direction of the flow of the cooling fluid through the cooling fins of that thermal exchanging section;

wherein a direction of the flow of the cooling fluid through the plurality of fins for each thermal exchanging section has an orientation that is different such that a substantially uniform fluid velocity is maintained irrespective of orientations of the thermal exchanging sections with respect to gravity.

12. The method of claim 11, wherein:

the cooling fluid is passed through at least four thermal exchanging sections, the cooling fluid flows through the fins of at least two first thermal exchanging sections in substantially parallel but in opposite directions; and the cooling fluid flows through the fins of at least two second thermal exchanging sections substantially perpendicular to the flow of the cooling fluid through the fins of the at least two first thermal exchanging sections.

13. The method of claim 12, wherein the thermal exchanging sections are coupled together in a series configuration.

14. The method of claim 11, further comprising directing the cooling fluid to the cooling fins of each thermal exchanging section using a protruding surface.

15. The method of claim 11, further comprising intercepting and distributing the cooling fluid into a plurality of flow fields in each thermal exchanging section using the cooling fins of each thermal exchanging section.

16. A multi-orientation coldplate that provides for efficient cooling irrespective of the coldplate's orientation comprising:

a first heat transfer section configured to transfer heat from the first heat transfer section to a cooling fluid, the first heat transfer section having an inlet with a converging inlet region for the cooling fluid and a divergent output region;

a second heat transfer section configured to transfer heat from the second heat transfer section to the cooling fluid, the second heat transfer section having a convergent input region and an outlet with a divergent outlet region for the cooling fluid; and a transition section connecting the divergent output region of the first heat transfer section and the convergent input region of the second heat transfer section;

wherein the first heat transfer section is separated and spaced apart from the second heat transfer section;

wherein the coldplate is configured such that the cooling fluid flows in substantially opposite directions in the first and second heat transfer sections;

wherein each heat transfer section comprises a plurality of cooling fins that have varying lengths and that are substantially parallel to each other;

wherein the coldplate is configured to direct the cooling fluid to enter or exit each heat transfer section in a direction substantially perpendicular to the cooling fins of that heat transfer section;

wherein the cooling fins within each heat transfer section are arranged in order of increasing length such that the cooling fins shorter in length are closer to where the cooling fluid enters that heat transfer section; and wherein ends of the cooling fins in each heat transfer section are aligned to form a line that is substantially perpendicular to the direction of the flow of the cooling fluid through the cooling fins of that heat transfer section.

17. The multi-orientation coldplate of claim 16, wherein the cooling fins of each heat transfer section are configured to intercept and distribute the cooling fluid into a plurality of flow fields.

18. The multi-orientation coldplate of claim 16, wherein the cooling fins of the first heat transfer section extend farther into the inlet as a cross-sectional area of the converging inlet region decreases.

19. The multi-orientation coldplate of claim 16, wherein each heat transfer section comprises a protruding surface configured to direct the cooling fluid to the cooling fins of that heat transfer section.

20. The multi-orientation coldplate of claim 16, wherein the transition section comprises a rounded corner separating the first and second heat transfer sections.

* * * * *

UNITED STATES PATENT AND TRADEMARK OFFICE

CERTIFICATE OF CORRECTION

PATENT NO. : 8,833,438 B2
APPLICATION NO. : 11/947033
DATED : September 16, 2014
INVENTOR(S) : Wyatt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1213 days.

Signed and Sealed this
Twenty-ninth Day of December, 2015

Michelle K. Lee

Michelle K. Lee
*Director of the United States Patent and Trademark Office*